US008967505B2

(12) United States Patent
Thomas et al.

(10) Patent No.: US 8,967,505 B2
(45) Date of Patent: Mar. 3, 2015

(54) METHOD AND APPARATUS FOR SHREDDING MEAT

(75) Inventors: Russell Thomas, Fayetteville, AR (US); Curtis D. Rinn, Flower Mound, TX (US); James Walthers, Farmington, AR (US)

(73) Assignee: Tyson Foods, Inc., Springdale, AR (US)

( * ) Notice: Subject to any disclaimer, the term of this patent is extended or adjusted under 35 U.S.C. 154(b) by 560 days.

(21) Appl. No.: 13/294,461

(22) Filed: Nov. 11, 2011

(65) Prior Publication Data

US 2013/0118325 A1 May 16, 2013

(51) Int. Cl.

| | |
|---|---|
| ***B02C 25/00*** | (2006.01) |
| ***B02C 23/00*** | (2006.01) |
| ***B02C 18/14*** | (2006.01) |
| ***B26D 3/22*** | (2006.01) |

(52) U.S. Cl.

CPC ..... *B02C 18/146* (2013.01); *B26D 3/22* (2013.01)

USPC ..... 241/30; 241/295

(58) Field of Classification Search

USPC ..... 241/30, 295

See application file for complete search history.

(56) References Cited

U.S. PATENT DOCUMENTS

| | | | | |
|---|---|---|---|---|
| 346,681 | A * | 8/1886 | Perry | 241/295 |
| 1,477,848 | A * | 12/1923 | Pardee | 241/295 |
| 2,472,188 | A * | 6/1949 | Azzel et al. | 241/243 |
| 3,027,106 | A * | 3/1962 | Brooks | 241/294 |
| 5,722,143 | A | 3/1998 | Bucks et al. | |
| 6,314,849 | B1 | 11/2001 | Arrasmith | |
| 6,561,067 | B2 | 5/2003 | Arrasmith | |
| 6,931,975 | B2 | 8/2005 | Haughton et al. | |
| 7,048,218 | B2 | 5/2006 | Hunag | |
| 7,500,630 | B2 * | 3/2009 | Rogers | 241/295 |

* cited by examiner

*Primary Examiner* — Faye Francis

(74) *Attorney, Agent, or Firm* — Husch Blackwell LLP; Mark E. Stallion

(57) ABSTRACT

An apparatus a circular blade device to produce consistent separated portions of a product to produce a severed portion, pulled and/or shredded product from cooked meat items or other food products as well as a more consistent sized crumble with precooked sausage based items. One embodiment can include a 16 point star shape with angled head or teeth to allow for the pulling of a consistent size product.

29 Claims, 3 Drawing Sheets

METHOD AND APPARATUS FOR SHREDDING MEAT

BACKGROUND OF INVENTION

1. Field of Invention

This invention relates generally to dicing or shredding food products and, more particularly, to blades for dicing or shredding meat products.

2. Background Art

Shortcomings in various existing equipment utilized for shredding food products, particularly meat products have been found and there are no commercially available equipment designs available for resolving the problems. When reviewing of the mechanical action of the machine, particularly the engagement of the cutting or shredding blades or knives with the meat product, the shortcomings are revealed. The engagement or cutting action of the commercially available tooling for the machine does not result in a product that appears to have been made by hand. It is desired in the industry for pizza toppings, pulled whole muscle meat products and other meat products. There doesn't appear to be an alternative tooling available in commerce that could be used to produce an item that met the customer design criteria, provide the desired pulling action and consistently produce product.

BRIEF SUMMARY OF INVENTION

One embodiment of the invention is a circular blade shredding device to produce a consistent separated, pulled, and/or shredded food product from food items including but not limited to vegetables, fruits, cheeses, cooked meat items as well as a more consistent sized crumble with precooked sausage based items. One embodiment can include a 16 point star shape with angled head or teeth to allow for separating, shredding and/or pulling of a consistent sized product. The blade provides an improved piece sizing in the product while maintaining the natural look desired from the product. Another embodiment includes an additional version with an 8 point shape and modified teeth.

One embodiment of the invention includes an angle cut of the star and spacing or greater pitch to allow for a more consistent separation, shred or pull from the product being separated, diced/shredded, or pulled and better control of the finished pieces. The bent star point solution improves the engagement, severing and pulling or shredding action. The device can be used on whole muscle smoked meats to create a hand-pulled-like consistent product and improved results can be seen in the resulting product. Consistent improved pulled sausage (having a hand-pinch like pull) or whole muscle (e.g. pulled pork) that was previously commercially unavailable from equipment manufactures can now be provided.

The engagement and separation action or interaction between the blade and the whole product being separated can vary depending on the speed of the blade, the angle of the points and the width of the blade. Also if adjacent blades are used in a side-to-side relationship then the spacing between adjacent blades and the side-to-side alignment of adjacent star points and their relative speeds can also vary the interaction. The texture, density, firmness, consistency and other aspects of the food product can also vary the interaction. For example, a whole pork meat cut having fibrous muscle tissue will respond to and interact with the blade differently than a cheese product and each of these will respond differently than a vegetable product or any other food product that differs in texture, density, firmness, consistency, pliability or any other characteristic difference. Previous star attachment cutting/shredding blades do not allow for the same separating, severing, shredding and/or pulling action due to the shape of the star points or teeth used. By turning the tips on an angle, a cut and pulling action is achieved, which improves product appearance and consistency. The point make the initial engagement with the product initiating the separation action rather than the rake area of the tooth. The rake area continues the engagement of the separated portion and the rake area has a varying angle that can increase or decrease the aggressiveness of the engagement and the pulling action.

These and other advantageous features of the present invention will be in part apparent and in part pointed out herein below.

BRIEF DESCRIPTION OF THE DRAWINGS

For a better understanding of the present invention, reference may be made to the accompanying drawings in which.

Figure 1:
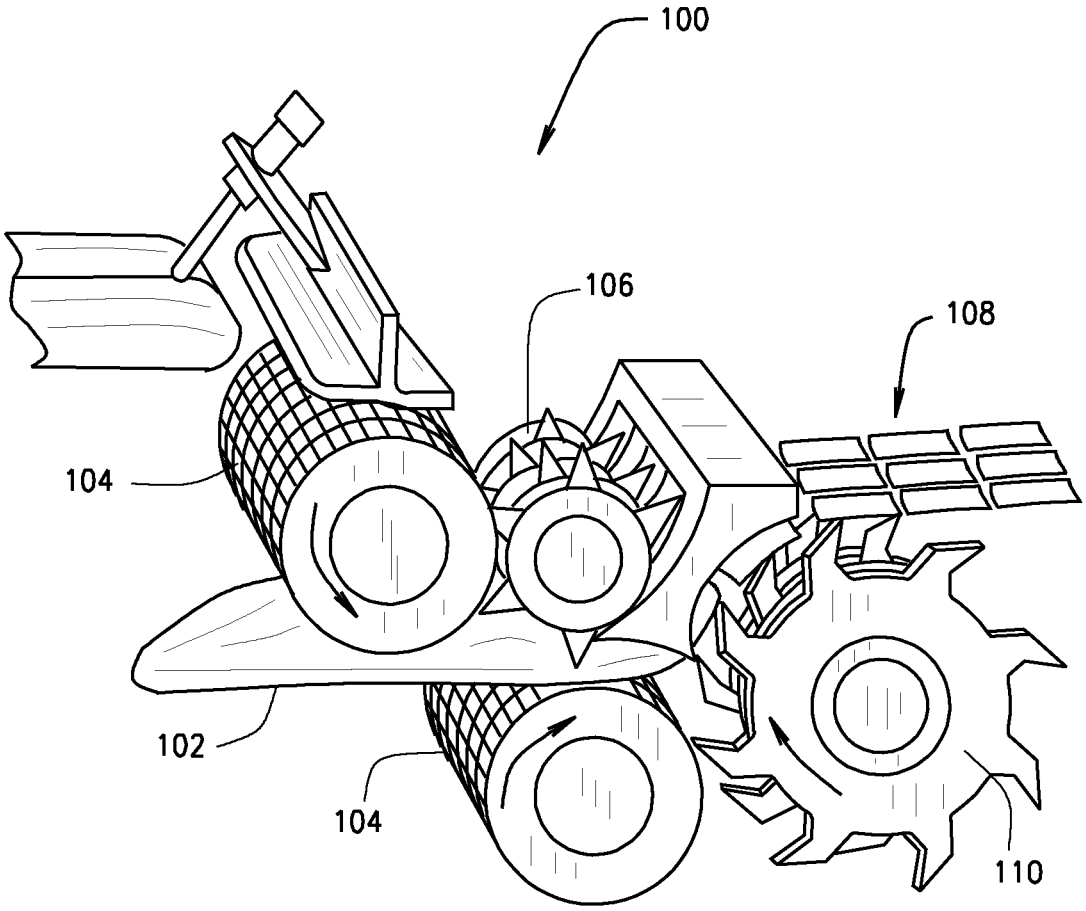
FIG. 1 is an illustration of a shredding configuration.

While the invention is susceptible to various modifications and alternative forms, specific embodiments thereof are shown by way of example in the drawings and will herein be described in detail. It should be understood, however, that the drawings and detailed description presented herein are not intended to limit the invention to the particular embodiment disclosed, but on the contrary, the intention is to cover all modifications, equivalents, and alternatives falling within the spirit and scope of the present invention as defined by the appended claims.

ITEM LIST

100 Shredder Assembly
102 Product
104 Feed Roller
106 Feed Disc
108 Shredded Product
110 Shredder Blade
200 Shredder Assembly
202 Product
204 Feed Roller
206 Feed Disc
208 Shredded Product
210 Shredder Blade
302 Blade Teeth
304 Leading Point
306 Upper Trailing Edge
307 Trailing Edge
308 Lower Trailing Edge
310 Upper Front Face Of Tooth
311 Front Face Of Tooth
312 Lower Front Face Of Tooth
314 Gulley
316 Blade Plate
318 Blade Hub
320 Upper Trailing Face Angle
322 Lower Trailing Face Angle
324 Upper Rake
326 Lower Rake
328 Tooth Diameter
330 Gulley Diameter
352 Blade Teeth

354 Leading Point
356 Upper Trailing Edge
357 Trailing Edge
358 Lower Trailing Edge
360 Upper Front Face Of Tooth
361 Front Face Of Tooth
362 Lower Front Face Of Tooth
364 Gulley

DETAILED DESCRIPTION OF INVENTION

Figure 2:
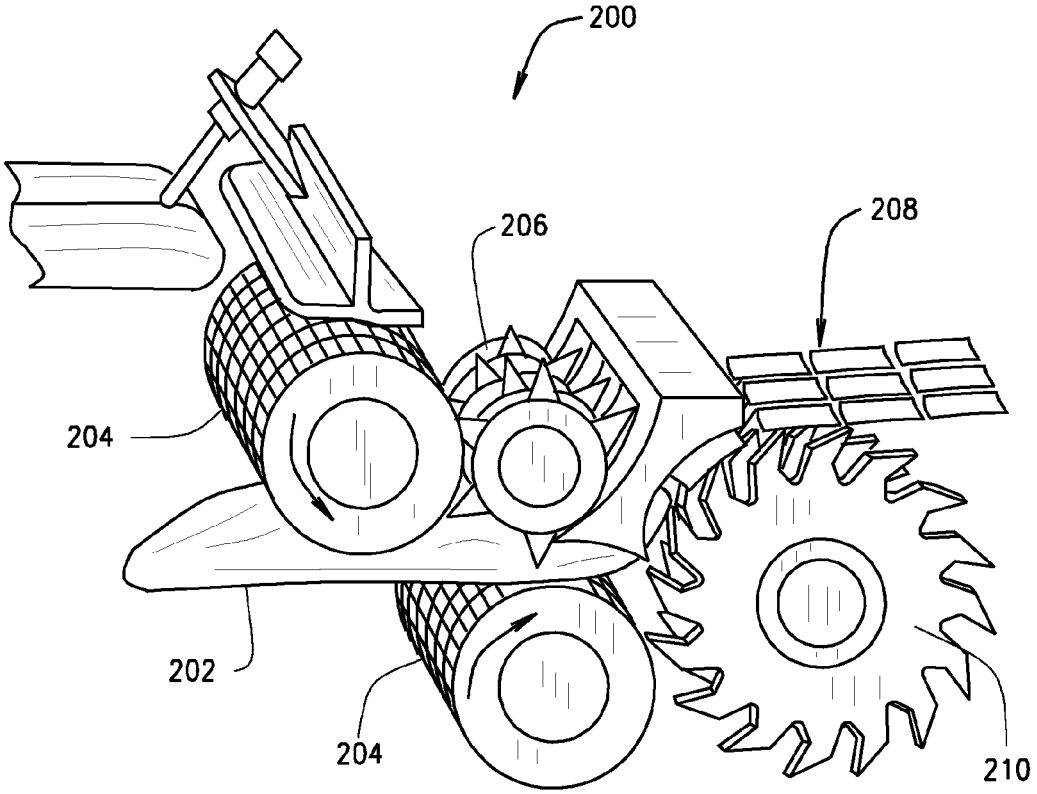
FIG. 2 is another illustration of a shredding configuration.

According to the embodiment(s) of the present invention, various views are illustrated in FIG. 1-3 and like reference numerals are being used consistently throughout to refer to like and corresponding parts of the invention for all of the various views and figures of the drawing. Also, please note that the first digit(s) of the reference number for a given item or part of the invention should correspond to the Fig. number in which the item or part is first identified.

One embodiment of the present invention comprising a circular shredder blade having a forward angled rake and leading point teaches a novel apparatus and method for separating or severing away portions of a food product. For example, one embodiment of the invention can be utilized for shredding a meat product.

The details of the invention and various embodiments can be better understood by referring to the figures of the drawing. Referring to FIG. 1, an illustration of a shredding configuration is shown. The Shredder Assembly 100 illustrated in FIG. 1 is representative of a typical cutter for a food product, particularly a meat shredder or meat dicer configuration. Although, this or a similar configurations can be used for other food products including but not limited to cheeses and vegetables. However the configuration can vary without departing from the scope of the invention. FIG. 1 illustrates a product such as a Meat Product 102 being fed through a set of Feed Rollers 104 and being pulled through the Feed Rollers by a Feed Disc 106 having teeth which engage the product thereby pulling the product through the Feed Rollers and urging the product toward the Shredder Blade 110. The term "shredder blade" used herein is utilized representatively to describe a blade that is not only its scope to be used to shred, but to more generally to separate or sever portions of the food product. Further, the term "shredding" or "shred" or "shreds" is also used herein representatively to include any separating action including severing away and pulling away. The Shredder Blade 110 pulls and separates or shreds meat from the meat product thereby forming a Shredded Meat Product 108 or other food product depending on the application. The rotational direction of the Feed Rollers and the Shredder Blade are indicated by the directional arrows. This configuration can be used to process beef and pork cuts as well as other meat cuts to create a pulled or shredded product. This or a similar configuration can also be used to separate away portions of a vegetable product. The configuration can also be used to process ground meat products such sausage and other ground meat products.

Referring to FIG. 2 there is another illustration of a shredding configuration. FIG. 2 illustrates another embodiment of a Shredder Assembly 200 including essentially the same components including the Feed Rollers 204 and the Feed Disc 206, which urge the food product toward an engagement with the Shredder Blade 210. The Shredder Blade again engages the meat product or other food product and shreds or separates sections of the meat away from the meat product thereby creating a Shredded Meat Product 208. Again, "shredded meat product", is used to representatively include separated food product. This embodiment illustrates a different blade configuration where the shredder blade has essentially the same diameter, however includes a greater number of teeth thereby reducing the spacing or pitch between the teeth.

Figure 3A:
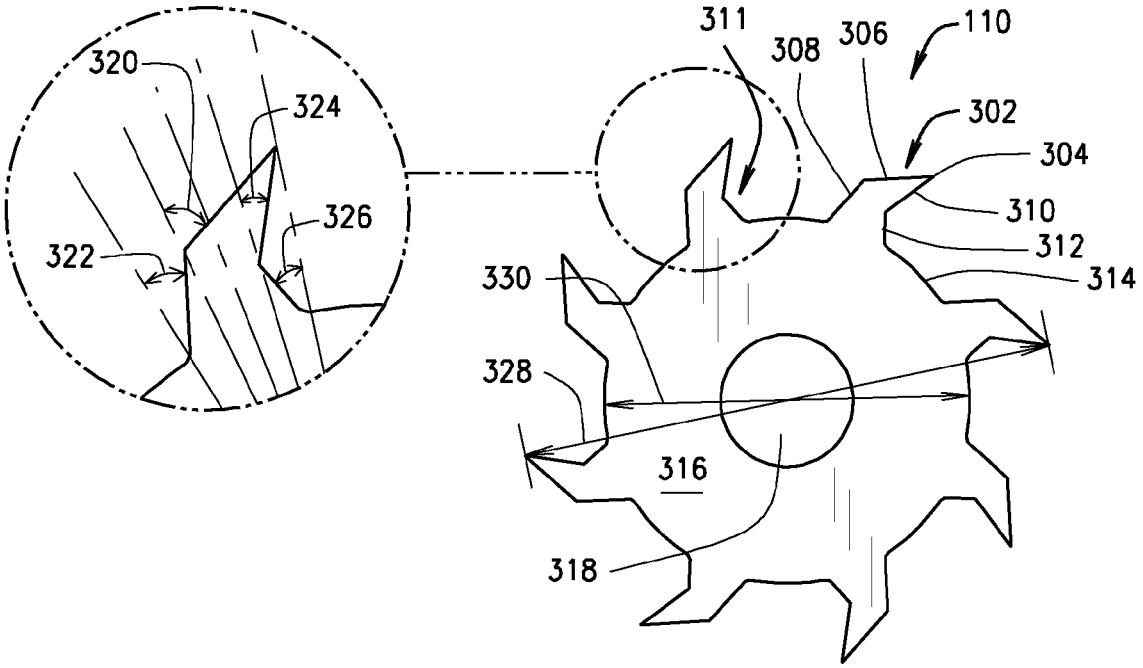
FIG. 3A is an illustration of a shredding blade.

Referring to FIG. 3A, there is an illustration of a shredding blade. FIG. 3A illustrates one embodiment of the Shredder Blade 110. This Shredder Blade embodiment includes a smaller number of teeth as compared to the other embodiment. The blade has a generally circular or disc-like profile in configuration having a certain width or plate thickness. The blade has a plurality of Blade Teeth 302, which are angled forward (positive rake) in order to create a engagement and pulling action when engaging the meat product. One embodiment of the blade could be a roller type blade having a similar profile but with a greater width or thickness. The Blade Teeth can include a Front Face having a Rake 311. The Forward Face of the Tooth 311 having a Rake can be separated into two portions including an Upper Front Face of the Tooth having an Upper Rake 324 of the Tooth 310 and a Lower Front Face of the Tooth having a Rake 326. The Upper Front Face of the Tooth can have a forward angled Rake (positive rake) or angle that extends over Gulley 314. The Lower Front Face of the Tooth can have, a Rake or angle that has angled backward (negative rake) with respect to the Gulley thereby creating a multi-angled rake or multi-angled Front Face of the Tooth.

The Gulley 314 between the teeth of the blade can have a facing surface with a convex arc consistent with the circular shape of the overall blade. The positive upper rake 324 with respect to an intersecting radial projection can have a positive angle between 5 to 35 degrees. The negative lower rake 326 with respect to a respective intersecting radial projection can have a negative angle between 5 to 35 degrees. The positive angles 320 and 322 respectively, of the upper 306 and lower 308 trailing faces with respect to their respective intersecting radial projections is between approximately 10° to 70°.

The blade teeth can also have a Trailing Edge 307 that is also multi-angled having an Upper Trailing Edge with a forward angle and a Lower Trailing Edge with a forward angle where the Upper Trailing Edge had a greater forward angle. The multi-angled Front Face of the Tooth having a combination of an Upper Forward Facing angle and a Lower Rearward facing angle creates a forward face that engages the meat product to thereby create a pulling action against the meat product thereby shredded in a manner similar to that of a hand shredding operation. The multi-angled Forward Face provides a greater surface of engagement with the meat product over a blade having a simple Rearward or Forward Facing angled surface. The diameter of the Blade Tip is illustrated by item 328 and the diameter Gulley to Gulley is illustrated by item 330. The Angles 322, 320, 324 and 326 illustrate the Multi-angled configuration of the Forward Face of the Tooth and the Drilling Edge of the Tooth.

Each of the plurality of spaced apart teeth have a positively facing tip 304 extending positively beyond any point of the respective rake such that the positively facing tip will engage and pull a product prior engagement of the respective rake. The outermost diameter tip to opposing tip is between approximately 6 to 7 inches and the pitch of the plurality of spaced apart teeth is approximately 1 to 3 inches.

It should be noted that without departing from the scope of the invention the blade including the plurality of spaced apart teeth can be positioned immediately adjacent a plurality of substantially identical blades and their respective spaced apart teeth and mounted to rotate about a common axially aligned hub. The blades can rotate synchronously, asynchronously or with a delay or stagger. The adjacent blade teeth of adjacent side-to-side blades can be aligned laterally and rotate in unison or the blade teeth can be staggered or off set such that adjacent blades do not impact the product at the same time.

Figure 3B:
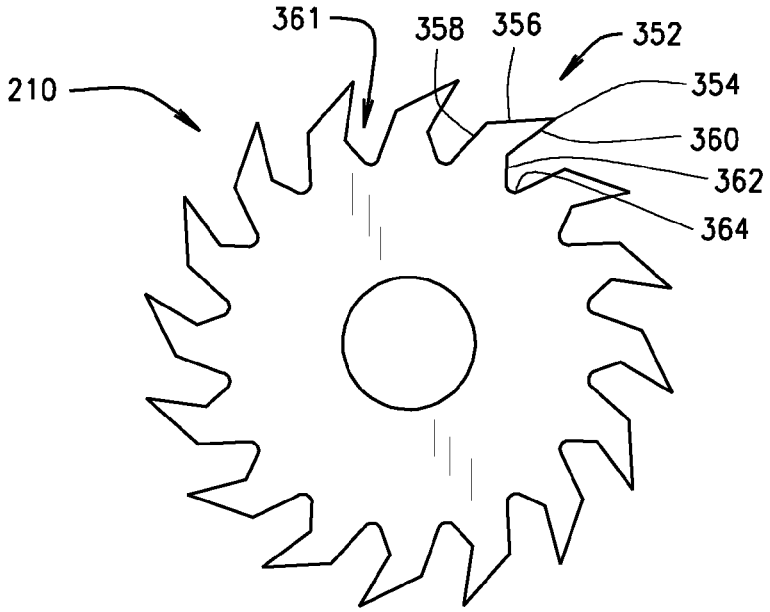
FIG. 3B is another illustration of a shredding blade.

Referring to FIG. 3B, there is another illustration of a shredding blade. FIG. 3B illustrates the Shredder Blade 210 having a greater number of Blade Teeth 352 however where the Front Face of the Tooth 361 and the Upper Front Face of the Tooth 360 and the Lower Front Face of the Tooth 362 are similar to that shown in FIG. 3A. Further, the Trailing Edge 357 and the Upper and Lower Trailing Edges 356 and 358 respectively are also similar to that shown in FIG. 3A. However, given the greater number of teeth the Gulley Area 364 is smaller or shorter and having a concave surface such that the distance between the teeth or the pitch is smaller. This shorter Gulley or shorter pitch will result in a different sized meat product thereby creating a finer shredded product than the blade shown in FIG. 3A.

One embodiment for the blade for shredding includes a blade having a generally circular profile with a generally circular periphery and a width. The blade can have a plurality of spaced apart teeth attached to the blade about the periphery where a pitch of the teeth defines a gulley between teeth and said plurality of teeth extending outward from the periphery and each of the plurality of spaced apart teeth having a front face of, where the front face has a multi angled rake including a positive upper rake and a lower negative rake. The distance gulley to gulley can be less than the length of the gulley or the distance gulley to gulley can be greater than the length of the gulley to thereby generate a finer shred.

FIG. 3A reflects a blade having the plurality of spaced apart teeth including eight equally spaced teeth. FIG. 3B illustrates the plurality of spaced apart teeth including sixteen equally spaced teeth. As shown in FIG. 3A, the gulley can have an outward facing surface that has a generally convex arcuate contour consistent with the generally circular profile of the blade. As shown in FIG. 3B the gulley can have an outward facing surface having a generally concave arcuate contour. Each of the plurality of spaced apart teeth can have a positively facing tip extending positively beyond any point of the respective rake such that the positively facing tip engages and pulls a product prior engagement of the respective rake. This configuration can be used to process various products including but not limited to beef and pork cuts as well as other meat cuts to create a pulled or shredded product. This configuration or similar configuration can also be used for other food products including but not limited to ground meat products, vegetables and other products. For example, this configuration can also be used to process ground meat products such as sausage and other ground meat products. For another example, a pulled pork product can be produced. Also, Italian sausage pizza crumbles can be manufactured from a ground sausage product.

With a pre-cooked ground sausage product, the sausage can be feed into a blade where the positive angle with respect to an intersecting radial projection of the positive upper rake is between approximately positive 5° to 35°; where the negative angle with respect to an intersecting radial projection of the negative lower rake is between approximately negative 5° to 35°; where the positive angle of the upper and lower trailing faces with respect to their respective intersecting radial projections is between approximately 10° to 70°; where each of the plurality of spaced apart teeth have a positively facing tip extending positively beyond any point of the respective rake such that the positively facing tip engages and pulls a product prior engagement of the respective rake; where the outermost diameter tip to opposing tip is between approximately 6 to 7 inches and the pitch of the plurality of spaced apart teeth is approximately 1 to 3 inches; and where the blade including the plurality of spaced apart teeth is positioned immediately adjacent a plurality of substantially identical blades and their respective spaced apart teeth and mounted to rotate about a common axially aligned hub.

Further, the blade including the plurality of spaced apart teeth can be positioned immediately adjacent a plurality of substantially identical blades and their respective spaced apart teeth and mounted to rotate about a common axially aligned hub as illustrated in FIG. 1.

The various shredder blade and shredder assembly examples shown above illustrate a method and apparatus for shredding a meat product. A user of the present invention may choose any of the above embodiments, or an equivalent thereof, depending upon the desired application. In this regard, it is recognized that various forms of the subject shredder blade and assembly could be utilized without departing from the spirit and scope of the present invention.

As is evident from the foregoing description, certain aspects of the present invention are not limited by the particular details of the examples illustrated herein, and it is therefore contemplated that other modifications and applications, or equivalents thereof, will occur to those skilled in the art. It is accordingly intended that the claims shall cover all such modifications and applications that do not depart from the sprit and scope of the present invention.

Other aspects, objects and advantages of the present invention can be obtained from a study of the drawings, the disclosure and the appended claims.

What is claimed is:

1. A blade for separating away portions of a product comprising: a blade having a generally circular profile with a generally circular periphery and a width; a plurality of spaced apart teeth attached to the blade about the periphery where a pitch of the teeth defines a gulley between teeth and said plurality of teeth extending outward from the periphery and each of the plurality of spaced apart teeth having a front face, where the front face has a multi angled rake including a positive upper rake and a lower negative rake and where each of the plurality of spaced apart teeth have a multi-angled trailing face including a positive angle upper trailing face and a positive angle lower trailing face.

2. The blade for separating as recited in claim 1, where the distance from an end of a gulley to a beginning of an adjacent gulley is less than the length of the gulley.

3. The blade for separating as recited in claim 1, where the distance from the end of the gulley to the beginning of the adjacent gulley is greater than the length of the gulley.

4. The blade for separating as recited in claim 1, where the plurality of spaced apart teeth includes eight equally spaced teeth.

5. The blade for separating as recited in claim 1, where the plurality of spaced apart teeth includes sixteen equally spaced teeth.

6. The blade for separating as recited in claim 1, where the gulley has an outward facing surface with a generally convex arcuate contour consistent with the generally circular profile of the blade.

7. The blade for separating as recited in claim 1, where the gulley has an outward facing surface with a generally concave arcuate contour.

8. The blade for separating as recited in claim 1, where the positive angle with respect to an intersecting radial projection of the positive upper rake is between approximately positive 5° to 35°.

9. The blade for separating as recited in claim 1, where the negative angle with respect to an intersecting radial projection of the negative lower rake is between approximately negative 5° to 35°.

10. The blade for separating as recited in claim 1, where the positive angle of the upper and lower trailing faces with respect to their respective intersecting radial projections is between approximately 10° to 70°.

11. The blade for separating as recited in claim 1, where each of the plurality of spaced apart teeth have a positively facing tip extending positively beyond any point of the respective rake such that the positively facing tip engages and pulls a product prior engagement of the respective rake.

12. The blade for separating as recited in claim 1, where the outermost diameter tip to opposing tip is between approximately 6 to 7 inches and the pitch of the plurality of spaced apart teeth is approximately 1 to 3 inches.

13. The blade for separating as recited in claim 1, where the blade including the plurality of spaced apart teeth is positioned immediately adjacent a plurality of substantially identical blades and their respective spaced apart teeth and mounted to rotate about a common axially aligned hub.

14. The blade for separating as recited in claim 1, where the width is greater than 1 inch.

15. A method for separating away portions of a product comprising the steps of: rotating a blade about a central hub, said blade having a generally circular profile with a generally circular periphery and a width, and further having a plurality of spaced apart teeth attached to the blade about the periphery where a pitch of the teeth defines a gulley between teeth and said plurality of teeth extending outward from the periphery and each of the plurality of spaced apart teeth having a front face of, where the front face has a multi angled rake including a positive upper rake and a lower negative rake; and engaging a product with the plurality of spaced apart teeth of the blade for separating away portions of the product, and where each of the plurality of space apart teeth have a multi-angled trailing face including a positive angle upper trailing face and a positive angle lower trailing face.

16. The method for separating as recited in claim 15, where the distance between an end of a gulley to a beginning of an adjacent gulley is less than the length of the gulley.

17. The method for separating as recited in claim 15, where the distance between the end of the gulley to the beginning of the adjacent gulley is greater than the length of the gulley.

18. The method for separating as recited in claim 15, where the plurality of spaced apart teeth includes eight equally spaced teeth.

19. The method for separating as recited in claim 15, where the plurality of spaced apart teeth includes sixteen equally spaced teeth.

20. The method for separating as recited in claim 15, where the gulley has an outward facing surface has a generally convex arcuate contour consistent with the generally circular profile of the blade.

21. The method for separating as recited in claim 15, where the gulley has an outward facing surface has a generally concave arcuate contour.

22. The method for separating as recited in claim 15, where the positive angle with respect to an intersecting radial projection of the positive upper rake is between approximately positive 5° to 35°.

23. The method for separating as recited in claim 15, where the negative angle with respect to an intersecting radial projection of the negative lower rake is between approximately negative 5° to 35°.

24. The method for separating as recited in claim 15, where the positive angle of the upper and lower trailing faces with respect to their respective intersecting radial projections is between approximately 10° to 70°.

25. The method for separating as recited in claim 15, where each of the plurality of spaced apart teeth have a positively facing tip extending positively beyond any point of the respective rake such that the positively facing tip engages and pulls a product prior engagement of the respective rake.

26. The method for separating as recited in claim 15, where the outermost diameter tip to opposing tip is between approximately 6 to 7 inches and the pitch of the plurality of spaced apart teeth is approximately 1 to 3 inches.

27. The method for separating as recited in claim 15, where the blade including the plurality of spaced apart teeth is positioned immediately adjacent a plurality of substantially identical blades and their respective spaced apart teeth and mounted to rotate about a common axially aligned hub, and further comprising the step of rotating the immediately adjacent and substantially identical blades for engagement with the product.

28. The method for separating as recited in claim 15, where the width is greater than 1 inch.

29. The method for shredding as recited in claim 15, where engaging the product with the plurality of spaced apart teeth includes urging the product to engage the spaced apart teeth with upper and lower inwardly and oppositely rotating pinch rollers.

* * * * *